United States Patent [19]

Iwakura et al.

[11] Patent Number: 4,682,193

[45] Date of Patent: Jul. 21, 1987

[54] RECORDING MATERIALS

[75] Inventors: Ken Iwakura, Kanagawa; Takekatsu Sugiyama, Shizuoka, both of Japan

[73] Assignee: Fuji Photo Film Co., Ltd., Kanagawa, Japan

[21] Appl. No.: 704,695

[22] Filed: Feb. 22, 1985

[30] Foreign Application Priority Data

Feb. 22, 1984 [JP] Japan ..... 59-31952
Feb. 22, 1984 [JP] Japan ..... 59-31953
Mar. 6, 1984 [JP] Japan ..... 59-42368

[51] Int. Cl.[4] ..... B41M 5/16; B41M 5/18; B41M 5/22

[52] U.S. Cl. ..... 503/209; 503/208; 503/214; 503/216; 503/225; 427/150

[58] Field of Search ..... 346/208, 209, 216, 217, 346/225, 214; 427/150–152

[56] References Cited

U.S. PATENT DOCUMENTS 4,399,188 8/1983 Yamato et al. ..... 346/225
4,467,339 8/1984 Asami et al. ..... 346/216

FOREIGN PATENT DOCUMENTS 0167296 10/1982 Japan ..... 346/216
0203592 12/1982 Japan ..... 346/225
0132594 8/1983 Japan ..... 346/216

*Primary Examiner*—Bruce H. Hess
*Attorney, Agent, or Firm*—Sughrue, Mion, Zinn, Macpeak & Seas

[57] ABSTRACT

A recording material is described, containing (A) an electron-donating colorless dye and (B) an electron-accepting compound, wherein the electron-accepting compound is a compound represented by formula (I)

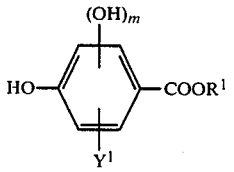

(I)

wherein $R^1$ represents an alkyl group, a cycloalkyl group, an aralkyl group, an aryl group, or an aryloxyalkyl group, $Y^1$ is an alkyl group, an alkoxyl group, a halogen atom, or a hydrogen atom, and m is 0, 1 or 2.

5 Claims, No Drawings

RECORDING MATERIALS

FIELD OF THE INVENTION

The present invention relates to a recording material utilizing a color-forming reaction between an electron-donating colorless dye and an electron-accepting compound, and more particularly to a recording material using specific electron-accepting compounds in specific combinations with other recording material components.

BACKGROUND OF THE INVENTION

It is known, as described in Japanese Patent Publication Nos. 9309/65, 4160/68, 14039/70, 29830/76, and 27253/80, U.S. Pat. Nos. 3,244,549 and 3,244,550 and British Pat. No. 1,135,540, that various phenol compounds can be used as electron-accepting compounds for the pressure-sensitive recording or heat-sensitive recording materials. These phenol compounds, however, are not completely satisfactory electron-accepting compounds, in that their color density when used in combination with electron donating colorless dyes is not as high as desired, and the stability of the color image formed is sometimes insufficient.

With respect to the increase in speed of heat-sensitive recording systems, extensive investigations have been made in recent years in order to improve color denisity, and several procedures have been proposed.

One proposed procedure is to control the melting point of the electron-accepting compound itself to within the range of from 60° to 100° C. However, it is difficult to control the melting points of phenolic compounds, which are now most widely used as electron-accepting compounds, within the above range. Furthermore, if the phenolic compounds are modified for that purpose, they become expensive. Thus, this procedure is not very suitable from a practical viewpoint.

Another method is disclosed in Japanese Patent Publication Nos. 17748/74 and 39567/76, in which an organic acid and a phenolic compound are used in combination with each other as the electron-accepting component, or a multivalent metal salt of a compound having an alcoholic hydroxyl group is used. In addition, Japanese Patent Publication No. 29945/76 discloses the use of a hydroxyethyl cellulose/maleic anhydride sald copolymer.

Japanese Patent Publication No. 27599/76 and Japanese Patent Application (OPI) No. 19231/73 (the term "OPI" as used herein refers to a "published unexamined Japanese patent application") disclose the addition of waxes.

Japanese Patant Application (OPI) Nos. 34842/74, 115554/74, 149353/75, 106746/77, 5636/78, 11036/78, 48751/78 and 72996/81 disclose that nitrogen-containing organic compounds such as thioacetanilide, phthalonitrile, acetamide, di-$\beta$-naphthyl-p-phenylenediamine, fatty acid amide, acetoacetic acid anilide, diphenylamine, benzamide, and carbazole, or heat-fusible materials such as 2,3-di-m-tolybutane, and 4,4'-dimethylbiphenyl, or carboxylic acid esters such as dimethyl isophthalate, diphenyl phthalate, and dimethyl terephthalate can be added as sensitizers. In addition, Published British Patent Specification No. 2,074,335A discloses the addition of hindered phenols.

However, heat-sensitive recording materials produced by any of the above methods are still not fully satisfactory in color density and the color-forming property.

Several methods have also been proposed with respect to increasing the stability of the color image in heat-sensitive recording materials. Japanese Patent Publication No. 43386/76 discloses a method in which phenol derivatives such as 2,2'-methylenebis(4-methyl-6-tert-butylphenol) are added. Japanese Patent Application (OPI) No. 17347/78 discloses the addition of water-insoluble modified phenol resins, such as resins modified with rosin. Japanese Patent Application (OPI) No. 72996/81 discloses the addition of terephthalic acid esters. In addition, Published British Patent Specification No. 2,074,335A discloses the incorporation of hindered phenols.

However, heat-sensitive recording materials produced by the above methods are still not fully satisfactory with respect to the stability of the image.

SUMMARY OF THE INVENTION

Accordingly, one object of the present invention is to provide a recording material containing an electron-accepting compound which when used in combination with an electron-donating colorless dye, can yield a desirably high color density.

Another object of the present invention is to provide a heat-sensitive recording material which is sufficiently satisfactory in color density and color senstivity (color-forming property).

A further object of the present invention is to provide a heat-sensitive recording material capable of producing a high density recorded image which is stable and does not readily disappear under the influences of external conditions such as moisture and heat.

In accordance with the present invention, a recording material is provided containing (A) an electron-donating colorless dye and (B) an electron-accepting compound, wherein the electron-accepting compound is a compound represented by formula (I)

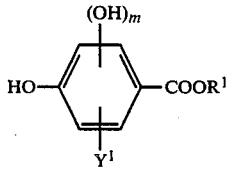

(I)

wherein $R^1$ represents an alkyl group, a cycloalkyl group, an aralkyl group, an aryl group, or an aryloxyalkyl group, $Y^1$ is an alkyl group, an alkoxy group, a halogen atom, or a hydrogen atom, and m is 0, 1, or 2.

DETAILED DESCRIPTION OF THE INVENTION

In the following description, the invention is illustrated by reference to various preferred embodiments and examples.

According to a first preferred embodiment, the present invention is directed to a recording material containing an electron-donating colourless dye and an electron-accepting compound wherein the electron-accepting compound is a compound represented by formula (IA)

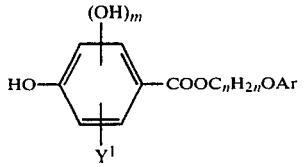

(IA)

wherein Ar represents an aryl group, $Y^1$ represents an alkyl group, an alkoxy group, a halogen atom, or a hydrogen atom, m is 0 or 1, and n is an integer of from 2 to 5.

Of the compounds represented by formula (IA), compounds represented by formulae (IA-1) to (IA-3) are preferred.

(IA-1)

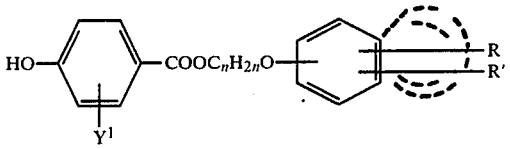

(IA-2)

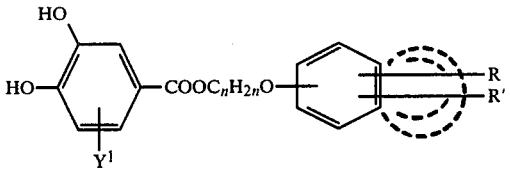

(IA-3)

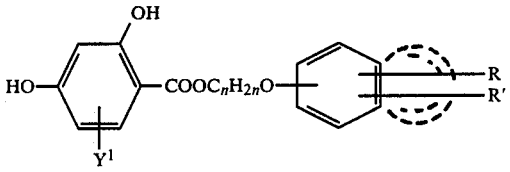

In formulae (IA-1) to (IA-3), R and R' (which may be the same or different) each represents a lower alkyl group, a lower alkoxyl group, a halogen atom, or a hydrogen atom, and $Y^1$ represents an alkyl group, an alkoxyl group, a halogen atom, or a hydrogen atom. Particularly preferred among these substituents are an alkyl group having from 1 to 4 carbon atoms, an alkoxyl group having from 1 to 3 carbon atoms, a chlorine atom, and a hydrogen atom. n is preferably from 2 to 4, and more preferably 2 or 3.

It is preferred that $Y^1$ represents an alkyl group having from 1 to 8 carbon atoms, an alkoxyl group having from 1 to 6 carbon atoms, a chlorine atom, a bromine atom, or a hydrogen atom. More preferably, $Y^1$ represents an alkyl group having from 1 to 6 carbon atoms, an alkoxyl group having from 1 to 4 carbon atoms, a chlorine atom, or a hydrogen atom.

The electron-accepting compound according to formula (IA) of the present invention is very useful as an electron-accepting compound, particularly for pressure-sensitive recording materials and heat-sensitive recording materials. In addition, it can be used in an electricity-sensitive recording sheet, a light-sensitive recording sheet, a supersonic wave recording sheet, an electron ray recording sheet, an electrostatic recording sheet, a light-sensitive print-making material, a sealing material, a typewriter ribbon, a ball-point pen ink, a crayon, etc.

When an electron-accepting compound of formula (IA) is used as an electron-accepting compound for a heat-sensitive recording material, it is preferred to have a melting point of 50° C. or more. Particularly preferred are compounds having a melting point of from 70° to 150° C.

The electron-accepting compound of formula (IA) has the following advantages.

(i) It produces a color image of high density when used in combination with an electron-donating colorless dye.

(ii) It is less soluble in water.

(iii) It does not sublimate and is stable.

(iv) It is easy to synthesize and can be produced in high purity and high yield. Moreover, starting material therefor is inexpensive.

Representative examples of the electron-accepting compounds of formula (IA) are set forth below, although the present invention is not limited thereto.

(1) β-Phenoxyethyl-p-hydroxybenzoate
(2) γ-Phenoxypropyl-p-hydroxybenzoate
(3) δ-Phenoxybutyl-p-hydroxybenzoate
(4) α-Methyl-β-phenoxyethyl-p-hydroxybenzoate
(5) β-Phenoxyethyl-3,4-dihydroxybenzoate
(6) γ-Phenoxypropyl-3,4-dihydroxybenzoate
(7) δ-Phenoxybutyl-3,4-dihydroxybenzoate
(8) α-Methyl-β-phenoxyethyl-3,4-dihydroxybenzoate
(9) β-Phenoxyethyl-2,4-dihydroxybenzoate
(10) β-Naphthyl(2)oxyethyl-2,4-dihydroxybenzoate
(11) γ-Phenoxypropyl-2,4-dihydroxybenzoate
(12) δ-Phenoxybutyl-2,4-dihydroxybenzoate
(13) α-Methyl-β-phenoxyethyl-2,4-dihydroxybenzoate
(14) β-o-Chlorophenoxyethyl-2,4-dihydroxybenzoate
(15) β-o-Tolyloxyethyl-2,4-dihydroxybenzoate
(16) β-(2-Methyl-6-chlorophenoxy)ethyl-2,4-dihydroxybenzoate
(17) β-(2-Chloro-4-methylphenoxy)ethyl-2,4-dihydroxybenzoate
(18) β-(2,4-Dimethylphenoxy)ethyl-2,4-dihydroxy-6-methylbenzoate
(19) β-Phenoxyethyl-2,4-dihydroxy-3-methylbenzoate
(20) β-o-Chlorophenoxyethyl-2,4-dihydroxy-3-methylbenzoate
(21) β-Phenoxyethyl-2,4-dihydroxy-5-chlorobenzoate
(22) β-Phenoxyethyl-2,4-dihydroxy-3-chlorobenzoate The electron-accepting compounds of formula (IA) can be used singly or in combination with each other, or in admixture with other electron-accepting compounds, such as bisphenol A, etc.

A second preferred embodiment of the present invention relates to a heat-sensitive recording material containing (A) an electron-donating colorless dye, (B) an electron-accepting compound, and (C) a heat-fusible material, preferably wherein the electron-accepting compound (B) is a benzoic acid ester derivative having a hydroxyl group in the 4-position and at least one additional aromatic hydroxyl group, and the heat-fusible material (C) Is at least one of (1) a phenol derivative, (2) a naphthol derivative, and (3) a compound having an amido group in the molecule, wherein compounds (1), (2) and (3) alone are substantially incapable of causing the electron-donating colorless dye to form a color.

Preferred electron-accepting compounds according to this second preferred embodiment are compounds represented by formulae (IB-1) to (IB-3)

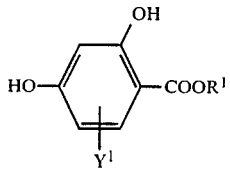
(IB-1)

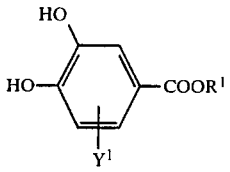
(IB-2)

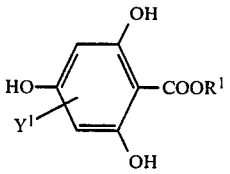
(IB-3)

In formulae (IB-1) to (IB-3), $R^1$ represents an alkyl group, an aralkyl group, an aryl group, or an aryloxyalkyl group, each of which may be further substituted, and $Y^1$ represents an alkyl group, an alkoxyl group, a halogen atom, or a hydrogen atom.

It is preferred that $R^1$ represents an alkyl group having from 2 to 12 carbon atoms, an aralkyl group having from 7 to 12 carbon atoms, an aryl group having from 6 to 12 carbon atoms, or an aryloxyalkyl group having from 8 to 16 carbon atoms. More preferably, $R^1$ represents an alkyl group having from 3 to 10 carbon atoms, an aralkyl group having from 7 to 10 carbon atoms, an aryl group having from 6 to 10 carbon atoms, or an aryloxyalkyl group having from 8 to 12 carbon atoms.

$R^1$ may be further substituted. Examples of such substituents are an alkoxyl group having from 1 to 6 carbon atoms, an aryloxy group having from 6 to 10 carbon atoms, a halogen atom, a cyano group, and an alkyl group having from 1 to 6 carbon atoms.

It is preferred that $Y^1$ represents an alkyl group having from 1 to 8 carbon atoms, an alkoxyl group having from 1 to 6 carbon atoms, a chlorine atom, a bromine atom, or a hydrogen atom. More preferably, $Y^1$ represents an alkyl group having from 1 to 6 carbon atoms, an alkoxyl group having from 1 to 4 carbon atoms, a chlorine atom, or a hydrogen atom.

Preferred phenol derivatives to be used as the heat-fusible materials in this second preferred embodiment include compounds represented by formula (II).

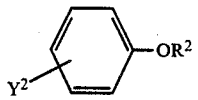
(II)

In formula (II), $R^2$ represents an acyl group, an alkyl group, or an aralkyl group, and $Y^2$ represents an alkyl group, an alkoxyl group, an aralkyl group, a phenyl group, a cyclohexyl group, a halogen atom, an alkoxycarbonyl group, or an aralkyloxycarbonyl group.

The alkyl group represented by $R^2$ preferably has from 1 to 20 carbon atoms, and more preferably has from 1 to 10 carbon atoms. The aralkyl group represented by $R^2$ preferably has from 7 to 20 carbon atoms. Particularly preferred examples are a benzyl group and a phenethyl group.

The alkyl group represented by $Y^2$ in formula (II) preferably has from 1 to 15 carbon atoms, and more preferably from 1 to 8 carbon atoms.

The alkoxyl group represented by $Y^2$ preferably has from 1 to 15 carbon atoms and more preferably from 1 to 8 carbon atoms. The aralkyl group represented by $Y^2$ preferably has from 7 to 20 carbon atoms, and more preferably from 7 to 11 carbon atoms. The halogen atom represented by $Y^2$ is preferably a chlorine atom.

The alkoxycarbonyl group represented by $Y^2$ preferably has from 2 to 12 carbon atoms, and more preferably from 2 to 8 carbon atoms. The aralkyloxycarbonyl group represented by $Y^2$ preferably has from 7 to 15 carbon atoms, and more preferably from 7 to 11 carbon atoms.

In formula (II), $Y^2$ may be present in any of the ortho-, meta-, and para-positions relative to the $OR^2$ group. It is preferred that $Y^2$ be located in the para-position.

Preferred naphthol derivatives to be used as the heat-fusible materials in this second preferred embodiment include compounds represented by formula (III).

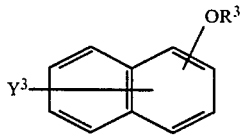
(III)

In formula (III), $R^3$ represents a hydrogen atom, an alkyl group, an aralkyl group, an alkylcarbonyl group, or an arylcarbonyl group, and $Y^3$ represents an alkyl group, an alkoxyl group, an alkoxycarbonyl group, an aryloxycarbonyl group, or a hydrogen atom.

In formula (III), it is preferred that $R^3$ represents an alkyl group having from 4 to 20 carbon atoms, an aralkyl group having from 7 to 24 carbon atoms, an alkylcarbonyl group having from 2 to 20 carbon atoms, or an arylcarbonyl group having from 7 to 20 carbon atoms. More preferably, $R^3$ represents an alkyl group having from 4 to 8 carbon atoms, an aralkyl group having from 7 to 9 carbon atoms, an alkylcarbonyl group having from 2 to 8 carbon atoms, an arylcarbonyl group having from 7 to 9 carbon atoms, or a hydrogen atom.

In formula (III), it is preferred that $Y^3$ represents an alkyl group having from 1 to 10 carbon atoms, an alkoxyl group having from 1 to 10 carbon atoms, an alkyloxycarbonyl group having from 2 to 20 carbon atoms, an aryloxycarbonyl group having from 7 to 20 carbon atoms, or a hydrogen atom. More preferably, $Y^3$ is an alkyl group having from 1 to 8 carbon atoms, an alkoxyl group having from 1 to 8 carbon atoms, an alkyloxycarbonyl group having from 2 to 10 carbon atoms, an aryloxycarbonyl group having from 7 12 carbon atoms, or a hydrogen atom.

Preferred examples of the compounds having an amido group in the molecule to be used as the heat-fusible materials in this second preferred embodiment include compounds represented by the formulae (IV) to (VI)

$$R^4-\underset{\underset{O}{\|}}{C}-NHR^5 \qquad \text{(IV)}$$

-continued

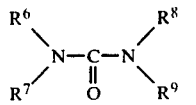

(V)

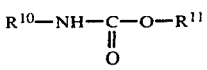

(VI)

In formula (VI), $R^4$ and $R^5$ (which may be the same or different) each represents an alkyl group, an aralkyl group, an aryl group, or a hydrogen atom.

In formulae (V) and (VI), $R^6$, $R^7$, $R^8$, $R^9$, $R^{10}$ and $R^{11}$ (which may be the same or different) each represents an alkyl group, an aryl group, or a hydrogen atom.

In formula (IV), it is preferred that $R^4$ and $R^5$ each represents an alkyl group having from 1 to 30 carbon atoms, an aralkyl group having from 7 to 20 carbon atoms, or an aryl group having from 6 to 20 carbon atoms. More preferably, $R^4$ and $R^5$ each represents an alkyl group having from 1 to 20 carbon atoms, an aralkyl group having from 7 to 10 carbon atoms, or an aryl group having from 6 to 10 carbon atoms. $R^4$ and $R^5$ may be further substituted. Preferred examples of such substituents include an alkyl group, an alkoxyl group, a halogen atom, an alkylcarbonyloxy group, an alkoxycarbonyl group, and an N-substituted carbamoyl group.

For the compounds represented by formula (IV), it is preferred that the total number of carbon atoms be at least 8.

The alkyl group represented by $R^6$, $R^7$, $R^8$ and $R^9$ in formula (V) preferably has from 1 to 18 carbon atoms. As alkyl groups having a substituent, those groups substituted with an alkoxyl group and having a total number of carbon atoms of from 3 to 12, and substituted with an aryloxyl group and having a total number of carbon atoms of from 7 to 21 are preferred. The aryl group may be substituted, and preferably has from 6 to 28 carbon atoms.

For compounds represented by formula (V), it is preferred that the total number of carbon atoms be at least 7.

The alkyl group represented by $R^{10}$ and $R^{11}$ in formula (VI) preferably has from 1 to 18 carbon atoms. As alkyl groups having a substituent, those groups substituted with an aryl group, an alkoxyl group, or an aryloxy group, and having a total number of carbon atoms of from 7 to 21 are preferred. Thr aryl group represented by $R^{10}$ preferably has from 6 to 28 carbon atoms.

For compounds represented by formula (VI), it is preferred that the total number of carbon atoms be at least 8.

Of the heat-fusible materials represented by formulae (II) to (VI), those compounds having a melting point of from 40° to 200° C. are preferred. Particularly preferred are compounds having a melting point of from 70° to 170° C.

In the heat-sensitive recording material of this second preferred embodiment containing the above-defined electron-accepting compound and heat-fusible material, the color density and color-forming property are quite satisfactory, the decrease in color-forming property with the lapse of time and fog are reduced, and the fastness of the color image formed is sufficiently high.

Representative examples of the electron-accepting compounds according to this second preferred embodiment are set forth below, although the present invention is not limited thereto.

Compounds according to formula (IB-1) are as follows:

(1) Propyl-2,4-dihydroxybenzoate
(2) Butyl-2,4-dihydroxybenzoate
(3) Cyclohexyl-2,4-dihydroxybenzoate
(4) Benzyl-2,4-dihydroxybenzoate
(5) p-Methylbenzyl-2,4-dihydroxybenzoate
(6) p-Chlorobenzyl-2,4-dihydroxybenzoate
(7) α-Phenylethyl-2,4-dihydroxybenzoate
(8) β-Phenylethyl-2,4-dihydroxybenzoate
(9) Ethyl-2,4-dihydroxy-6-methylbenzoate
(10) Propyl-2,4-dihydroxy-6-methylbenzoate
(11) Ethyl-2,4-dihydroxy-6-isopropylbenzoate
(12) Ethyl-2,4-dihydroxy-6-pentylbenzoate
(13) Butyl-2,4-dihydroxy-6-methoxybenzoate
(14) Cyclohexyl-2,4-dihydroxy-6-methylbenzoate
(15) Benzyl-2,4-dihydroxy-6-methylbenzoate
(16) p-Chlorobenzyl-2,4-dihydroxy-6-propylbenzoate
(17) p-Methylbenzyl-2,4-dihydroxy-6-methoxybenzoate
(18) p-Isopropylbenzyl-2,4-dihydroxy-6-methylbenzoate
(19) p-Methylphenoxyethyl-2,4-dihydroxy-6-methylbenzoate
(20) p-Chlorobenzyl-2,4-dihydroxy-5-chlorobenzoate
(21) β-Phenoxyethyl-2,4-dihydroxybenzoate
(22) β-p-Methylphenoxyethyl-2,4-dihydroxybenzoate
(23) γ-Phenoxypropyl-2,4-dihydroxybenzoate
(24) β-Naphthyl(2)oxyethyl-2,4-dihydroxybenzoate
(25) β-o-Chlorophenoxyethyl-2,4-dihydroxybenzoate
(26) βo-Methylphenoxyethyl-2,4-dihydroxybenzoate
(27) β-(2-Chloro-4-methylphenoxyl)ethyl-2,4-dihydroxybenzoate
(28) β-(2-Methyl-6-chlorophenoxy)ethyl-2,4-dihydroxybenzoate
(29) β-(2,4-Dimethylphenoxy)ethyl-2,4-dihydroxy-6-methylbenzoate
(30) β-Phenethyl-2,4-dihydroxy-6-methylbenzoate
(31) β-Phenoxyethyl-2,4-dihydroxy-6-methylbenzoate
(32) β-Phenoxyethyl-2,4-dihydroxy-3-methylbenzoate
(33) β-Phenethyl-2,4-dihydroxy-3-methylbenzoate
(34) Benzyl-2,4-dihydroxy-3-methylbenzoate
(35) β-o-Chlorophenoxyethyl-2,4-dihydroxy-3-methylbenzoate
(36) β-Phenethyl-2,4-dihydroxy-5-chlorobenzoate
(37) Benzyl-2,4-dihydroxy-5-chlorobenzoate
(38) β-Phenoxyethyl-2,4-dihydroxy-5-chlorobenzoate
(39) Benzyl-2,4-dihydroxy-3-chlorobenzoate Compounds according to formula (IB-2) are as follows:

(1) Butyl-3,4-dihydroxybenzoate
(2) Benzyl-3,4-dihydroxybenzoate
(3) β-Phenylethyl-3,4-dihydroxybenzoate
(4) Benzyl-3,4-dihydroxy-5-chlorobenzoate
(5) α-Phenylethyl-3,4-dihydroxybenzoate Compounds according to formula (IB-3) are as follows:

(1) Butyl fluoroglycinecarboxylate
(2) Propyl fluoroglycinecarboxylate
(3) β-Phenoxyethyl fluoroglycinecarboxylate
(4) Cyclohexyl fluoroglycinecarboxylate
(5) Benzyl fluoroglycinecarboxylate
(6) p-Chlorobenzyl fluoroglycinecarboxylate
(7) o-Chlorobenzyl fluoroglycinecarboxylate
(8) p-Methylbenzyl fluoroglycinecarboxylate
(9) α-Phenethyl fluoroglycinecarboxylate
(10) β-Phenethyl fluoroglycinecarboxylate

(11) p-Isopropylbenzyl fluoroglycinecarboxylate
(12) Phenyl fluoroglycinecarboxylate
(13) m-Tolyl fluoroglycinecarboxylate These electron-accepting compounds of formulae (IB-1) to (IB-3) can be used singly or in combination with each other, or with other electron-accepting compounds such as bisphenol A, etc.

Representative examples of heat-fusible materials according to this preferred embodiment are shown below.

Compounds according to formula (II):

p-tert-Butylphenyl benzyl ether, p-tert-amylphenyl benzyl ether, p-isopropylbenzyl p-biphenyl ether, β-phenethyl p-biphenyl ether, α-phenethyl p-biphenyl ether, β-n-butoxyethyl p-biphenyl ether, p-cyclohexyl phenylbenzyl ether, p-cumylphenyl benzyl ether, p-isopropylbenzyl p-anisyl ether, p-chlorophenyl p-isopropylbenzyl ether, methyl p-benzyloxybenzoate, and benzyl p-benzyloxybenzoate.

Compounds according to formula (III):

1-Benzyloxynaphthalene, 2-benzyloxynaphthalene, 2-p-methylbenzyloxynaphthalene, 2-p-chlorobenzyloxynaphthalene, 2-p-isopropylbenzyloxynaphthalene, 2-benzoyloxynaphthalene, 1-hydroxy-2-benzoyloxynaphthalene, 2-phenoxyacetyloxynaphthalene, 1-hydroxy-2-phenoxycarbonylnaphthalene, and 1hydroxy-2-butoxycarbonylnaphthalene.

Compounds according to formula (IV):

Stearoylanilide, stearoyl-p-toludide, stearoyl-p-chloroanilide, N-p-chlorobenzoylstearylamine, N-p-chlorobenzoylbenzylamine, N-p-chlorobenzoyl-p'-chlorobenzylamine, phenylacetyl-p-chloroanilide, p-chlorophenylacetyl-p'-chloroanilide, p-tolylacetyl-p'-chloroanilide, stearic acid methyl amide, phenoxyacetic acid stearylamide, 2-naphthoxyacetic acid stearylamide, phenylacetic acid stearylamide, stearic acid amide, behenic acid amide, benzoic acid stearylamide, p-chlorobenzoic acid stearylamide, p-chlorobenzoic acid γ-dodecyloxypropylamide, 1,3-bis(stearoylamino)propane, 1,6-bis(capryloylamino)hexane, 1,3-bis(-phenylacetylaminomethyl)benzene, 1,3-bis(capyrloylaminomethyl)cyclohexane, p-anisylic acid stearylamide, and p-methoxycarbonylbenzoic acid stearyl amide.

Compounds according to formula (V):

1-Phenylurea, 1-methyl-3-phenylurea, 3-phenyl-1,1-dipropylurea, 1-pentenyl-3-phenylurea, 1,1-dipentyl-3-phenylurea, 1,3-dioctadecylurea, 1-dodecyl-3-phenylurea, 1-octadecyl-3-phenylurea, 1-cyclohexyl-3-phenylurea, 1,1-dicyclohexyl-3-phenylurea, 1-octadecylurea, 1-dodecyl-3-butylurea, and 1-benzyl-3-butylurea.

Compounds according to formula (VI):

Phenylcarbamoyloxydodecane, phenylcarbamoyloxyoctadecane, phenylcarbamoyloxymethylbenzene, octadecylcarbamoyloxymethylbenzene, 4,4'-bis(-dodecyloxycarbonylamino)diphenylmethane, 2,4-bis(-dodecyloxycarbamoylamino)toluene, 1,6-bis(hexadecyloxycarbonylamino)heptane, and 1,3-bis(phenylcarbamoyloxy)propane.

These heat-fusible materials can be used singly or in combination with each other.

A third preferred embodiment of the present invention relates to a heat-sensitive recording material containing (A) an electron-donating colorless dye, (B) an electron-accepting compound, and (D) a hindered phenol compound.

Preferred electron-accepting compounds are dihydroxybenzoic acid esters of compounds represented by formulae (IC-1) and (IC-2).

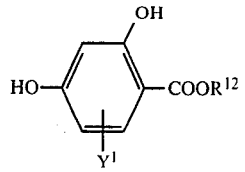

(IC-1)

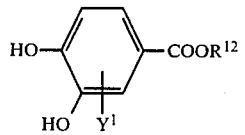

(IC-2)

In formulae (IC-1) and (IC-2), $R^{12}$ represents an alkyl group having at least two carbon atoms, a cycloalkyl group having at least five carbon atoms, an aralkyl group having at least seven carbon atoms, or an aryloxyalkyl group having at least eight carbon atoms, each of which may be further substituted, and $Y^1$ represents an alkyl group, an alkoxyl group, a halogen atom, or a hydrogen atom.

In formulae (IC-1) and (IC-2), it is preferred that $R^{12}$ represents an alkyl group having from 2 to 10 carbon atoms, a cycloalkyl group having from 5 to 7 carbon atoms, an aralkyl group having from 7 to 12 carbon atoms, or an aryloxyaklyl group having from 8 to 16 carbon atoms. More preferably, $R^{12}$ represents an alkyl group having from 2 to 6 carbon atoms, a cyclohexyl group, aan aralkyl group having from 7 to 10 carbon atoms, or an aryloxyalkyl group having from 8 to 12 carbon atoms.

$R^{12}$ may be further substituted with groups such as a lower alkoxyl group, a halogen atom, a phenoxy group, and a lower alkyl group.

It is preferred that $Y^1$ represents an alkyl group having from 1 to 8 carbon atoms, an alkoxyl group having from 1 to 6 carbon atoms, a chlorine atom, a bromine atom, or a hydrogen atom. More preferably, $Y^1$ represents an alkyl group having from 1 to 6 carbon atoms, an alkoxyl group having from 1 to 4 carbon atoms, a chlorine atom, or a hydrogen atom.

Representative examples of dihydroxybenzoic acid esters represented by formulae (IC-1) and (IC-2) are set forth below.

(1) Propyl-2,4-dihydroxybenzoate
(2) Butyl-2,4-dihydroxybenzoate
(3) Cyclohexyl-2,4-dihydroxybenzoate
(4) Benzyl-2,4-dihydroxybenzoate
(5) p-Methylbenzyl-2,4-dihydroxybenzoate
(6) p-Chlorobenzyl-2,4-dihydroxybenzoate
(7) α-Phenylethyl-2,4-dihydroxybenzoate
(8) Butyl-3,4-dihydroxybenzoate
(9) Benzyl-3,4-dihydroxybenzoate
(10) β-Phenylethyl-3,4-dihydroxybenzoate
(11) β-Phenoxyethyl-2,4-dihydroxybenzoate
(12) β-p-Methylphenoxyethyl-2,4-dihydroxybenzoate
(13) γ-Phenoxypropyl-2,4-dihydroxybenzoate
(14) β-Naphthyl(2)oxyethyl-2,4-dihydroxybenzoate
(15) β-o-Chlorophenoxyethyl-2,4-dihydroxybenzoate
(16) β-o-Methylphenoxyethyl-2,4-dihydroxybenzoate
(17) β-(2-Chloro-4-methylphenoxy)ethyl-2,4-dihydroxybenzoate

(18) β-(2-Methyl-6-chlorophenoxy)ethyl-2,4-dihydroxybenzoate
(19) β-(2,4-Dimethylphenoxy)ethyl-2,4-dihydroxy-6-methylbenzoate
(20) β-Phenethyl-2,4-dihydroxy-6-methylbenzoate
(21) β-Phenoxyethyl-2,4-dihydroxy-6-methylbenzoate
(22) β-Phenoxyethyl-2,4-dihydroxy-3-methylbenzoate
(23) β-Phenethyl-2,4-dihydroxy-3-methylbenzoate
(24) Benzyl-2,4-dihydroxy-3methylbenzoate
(25) β-o-Chlorophenoxyethyl-2,4-dihydroxy-3-methylbenzoate
(26) β-Phenethyl-2,4-dihydroxy-5-chlorobenzoate
(27) Benzyl-2,4-dihydroxy-5-chlorobenzoate
(28) β-Phenoxyethyl-2,4-dihydroxy-5-chlorobenzoate
(29) Benzyl-2,4-dihydroxy-3-chlorobenzoate These dihydroxybenzoic acid esters can be used in combination with each other.

Preferred among the hindered phenol compounds (also referred to herein as "image storage stability-increasing agents") of this third preferred embodiment are phenols substituted with an alkyl group in at least one of 2- and 6-positions and its derivatives. In particular, phenols substituted with a tert-butyl group in at least one of the 2- and 6-positions and its derivatives are preferred. In addition, compounds having a plurality of phenol groups, particularly 2 or 3 phenol groups in the molecule, are preferred. Representative examples of these compounds are set forth below.

Bis[3,3-bis(4'-hydroxy-3'-tert-butylphenyl)butanoic acid]glycol ester
Bis[3,3-bis(4'-hydroxy-3',4'-di-tert-butylphenyl)-butanoic acid]glycol ester
Bis[3,3-bis(2'-methyl-4'-hydroxy-5'-tert-butylphenyl)-butanoic acid]glycol ester
1,1,3-Tris(2-methyl-4-hydroxy-5-tert-butylphenyl)butane
4,4'-Thiobis(3-methyl-6-tert-butylphenol)
4,4'-Thiobis(2-methyl-6-tert-butylphenol)
2,2'-Thiobis(4-methyl-6-tert-butylphenol)
2,2'-Methylenebis(4-methyl-6-tert-butylphenol)
2,2'-Methylenebis(4-ethyl-6-tert-butylphenol)
4,4'-Butylidenebis(3-methyl-6-tert-butylphenol)
4,4'-Methylenebis(2,6-di-tert-butylphenol)
2-tert-Butyl-4-tert-butoxyphenol
2,2-Dimethyl-4-isopropyl-7-tert-butyl-6-cumanol
2,2-Dimethyl-6-tert-butyl-5-benzofuranol
4-{[4,6-Bis(tert-butylthio)-s-triazine-2-yl]amino}-2,6-di-tert-butylphenol The amount of the hindered phenol compound used in this third preferred embodiment is generally from 5 to 200% by weight, and preferably from 20 to 100% by weight, based on the weight of the electron-accepting compound.

For the heat-sensitive recording material of this third preferred embodiment containing the above-defined electron-accepting compound and hindered phenol compound, the color density is sufficiently high, and the color image formed is very stable; it undergoes almost no discoloration or fading even when irradiated with light, heated, or placed under high moisture conditions for long periods of time. Thus, the heat-sensitive recording material of this third preferred embodiment of the present invention is particularly preferred in that the color image can be stored for long periods of time.

Electron-donating colorless dyes which can be used in the present invention include triarylmethane-based compounds, diphenylmethane-based compounds, xanthene-based compounds, thiazine-based compounds, and spiropyran-based compounds. Typical examples of such compounds are shown below.

Triarylmethane-based compounds include 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc.

Diphenylmethane-based compounds include 4,4'-bis-dimethylaminobenzhydrin benzyl ether, N-halophenylleucoauramine, N-2,4,5-trichlorophenyl-leucoauramine, etc.

Xanthene-based compounds include rhodamine-B-anilinolactam, rhodamine(p-nitroanilino)lactam, rhodamine-B-(p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-N-cycloheyxl-N-methylaminofluoran, 2-anilino-3-methyl-6-N-ethyl-N-isoamylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran, 2-anilino-3-methyl-5-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-diethylaminofluoran, 2-phenyl-6-diethylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-phenyl-6-diethylaminofluoran, 2-diethylamino-3-phenyl-6-diethylaminofluoran, 2-o-chloroanilino-6-dibutylaminofluoran, 2-anilino-3-methyl-6-dioctylaminofluoran, 2-p-chloroanilino-3-methyl-6-butylaminofluoran, 2-p-chloroanilino-3-ethoxy-6-N-ethyl-N-isoamylaminofluoran, 2-o-chloroanilino-6-p-butylanilinofluoran, 2-anilino-3-octadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-methyl-6-N-ethyl-N-butylaminofluoran, 2-anilino-3-chloro-6-N-ethyl-N-isoamylaminofluorane, etc.

Thiazine-based compounds include benzoyl leucomethylene blue, p-nitrobenzyl leucomethylene blue, etc.

Spiro-based compounds include 3-methyl-spirodinaphthopyran, 3-ethyl-spiro-dinaphthopyran, 3,3'-dichloro-spiro-dinaphthopyran, 3-benzyl-spiro-dinaphthopyran, 3-methylnaphtho(3-methoxybenzo)-spiro-pyran, 3-propyl-spiro-dibenzopyran, etc.

These electron-donating compounds can be used singly or in combination with each other.

A process for the production of the recording material of the present invention will hereinafter be explained.

A pressure-sensitive copying paper according to the present invention may take various forms as described in U.S. Pat. Nos. 2,505,470, 2,505,471, 2,505,489, 2,548,366, 2,712,507, 2,730,456, 2,730,457 and 3,418,250.

Most typically, the pressure-sensitive copying paper comprises at least one pair of sheets, one of which contains an electron-donating colorless dye and the other an electron-accepting compound. That is, one or more of electron-donating colorless dyes are dissolved in a solvent (e.g., synthetic oil such as alkylated naphthalene, alkylated diphenyl, alkylated diphenylmethane, and alkylated terphenyl; vegetable oil such as cotton seed oil and castor oil; animal oil; mineral oil; and mixtures thereof), dispersed in a binder or encapsulated, and then coated on a support such as paper, a plastic sheet, and a resin-coated paper to produce a color former sheet. On the other hand, one or more electron-accepting compounds are dispersed in a binder such as a styrene/butadiene latex and polyvinyl alcohol (if desired in combination with other electron-accepting compounds), and then coated on a support such as paper, a plastic sheet, and a resin-coated paper to produce a developer sheet.

The amounts of the electron-donating colorless dye and electron-accepting compound used vary with the desired coating thickness, the form of the pressure-sensitive copying paper, the method of preparing capsules, and other conditions. Thus, the amounts can be determined appropriately by one skilled in the art taking into consideration the above factors.

Microcapsules can be produced by known techniques such as a method utilizing coacervation of hydrophilic colloid sol as described in U.S. Pat. Nos. 2,800,457 and 2,800,458, and an interfacial polymerization method as described in British Pat. Nos. 867,797, 950,443, 989,264 and 1,091,076.

In producing a heat-sensitive recording material, a binder is dissolved or dispersed in a solvent or dispersing medium, and to the thus-prepared solution or dispersion, an electron-donating colorless dye, an electron-accepting compound of the present invention, and, according to a preferred embodiment as described above, a finely divided heat-fusible material are added. Furthermore, an oil-absorbing pigment such as kaolin, calcined kaolin, talc, agalmatolite, diatomaceous earth, calcium carbonate, aluminum hydroxide, magnesium hydroxide, magnesium carbonate, titanium oxide, barium carbonate, a urea/formalin filler, a cellulose filler, and the like can be added to prepare a coating solution. In addition, if desired, a paraffin wax emulsion, a latex-based binder, a sensitivity-increasing agent, a metallic soap, an antioxidant, an ultraviolet absorber, an image storage stability-increasing agent, etc., can be added to the coating solution.

This coating solution is coated on a support such as paper, a plastic sheet, and a resin-coated paper and then dried. In preparing the coating solution, all the constituents may be mixed at the same time and pulverized, or they may be divided into several groups, which are pulverized separately and then mixed.

The coating solution may be allowed to penetrate into the support.

In the case of the heat-sensitive recording material, the relative amounts of the constituents used are generally within the following ranges.

| | |
|---|---|
| Electron-donating colorless dye | 1 part by weight |
| Electron-accepting compound | 0.5 to 10 part by weight |
| Heat-fusible material | 0 to 30 part by weight |
| Pigment | 0 to 15 part by weight |

-continued

| | |
|---|---|
| Binder | 1 to 15 part by weight |

The preferred proportion of the electron-donating colorless dye and the electron-accepting compound is from 1:5 to 2:1 (weight ratio).

The electron-donating colorless dyes may be used singly or in combinations with each other. As the dispersing medium (solvent), water is most desirable.

Examples of binders which can be used in the present invention include a styrene/butadiene copolymer, an alkyd resin, an acrylamide copolymer, a vinyl chloride/vinyl acetate copolymer, a styrene/maleic anhydride copolymer, synthetic rubber, gum arabic, polyvinyl alcohol, and hydroxyethyl cellulose.

Particularly in view of the dispersing medium (solvent), water-soluble binders such as gum arabic, polyvinyl alcohol, hydroxymethyl cellulose, and carboxymethyl cellulose are desirable.

In addition to the heat-fusible materials described above with respect to the second preferred embodiment, examples of heat-fusible materials that can be generally used according to the present invention include erucic acid, stearic acid, behenic acid, palmitic acid, stearic acid amide, behenic acid amide, stearic acid anilide, stearic acid toluidide, N-myristoyl-p-anisidine, N-myristolyl-p-phenetidine, 1-methoxycarbonyl-4-N-stearylcarbamoylbenzene, N-octadecyl urea, N-hexadecyl urea, N,N'-didodecyl urea, phenylcarbamoyloxydodecane, p-tert-butylphenol phenoxy acetate, p-phenylphenol-p-chlorophenoxy acetate, 4,4'-isopropylidenebismethoxybenzene, β-phenylethyl-p-phenyl phenyl ether, 2-p-chlorobenzyloxynaphthalene, 2-benzyloxynaphthalene, 1-benzyloxynaphthalene, 2-phenoxyacetyloxynaphthalene, diphenyl phthalate, phenyl 1-hydroxy-2-naphthoate, 2-benzoyloxynaphthalene, benzyl p-benzyloxybenzoate, and hydroquinone acetate.

Such heat-fusible materials are colorless solids at ordinary temperature and have a sharp melting point falling within the temperature range suitable for heating for the purpose of copying, i.e., from about 70° to 160° C.

Examples of waxes which can be used include paraffin wax, carnauba wax, microcrystalline wax, and polyethylene wax. In addition, higher fatty acid amides such as stearic acid amide, ethylene bisstearoamide, higher fatty acid esters, etc., can be used.

Examples of metallic soaps which can be used include higher fatty acid multivalent metal salts such as zinc stearate, aluminum stearate, calcium stearate, and zinc oleate.

The hindered phenol compounds described above with respect to the third preferred embodiment can be generally used according to other embodiments of the present invention as an image storage stability-increasing agents.

The amount of the above image storage stability-increasing agents used is generally from 5 to 200% by weight, and preferably from 20 to 100% by weight, based on the weight of the electron-accepting compound.

The present invention is described in greater detail with reference to the following examples.

EXAMPLE 1

(1) Production of Color Former Sheet 1 g of 2-anilino-3-methyl-6-diethylaminofluoran as an electron-donating colorless dye was dissolved in 30 g of alkylated naphthalene. The resulting solution was added to 50 g of water in which 6 g of gelatin and 4 g of gum arabic had been dissolved, while vigorously stirring to emulsify therein, to prepare an emulsion containing droplets with a diameter of from 1 to 10 μm. Subsequently, 250 g of water was added. Acetic acid was added in small amounts to adjust the pH to about 4, thereby causing coacervation, whereupon a wall of gelatin and gum arabic was formed on each oil droplet. Formalin was added and the pH was increased to 9 to harden the wall.

The thus-prepared microcapsule dispersion was coated on paper and then dried to produce a color former sheet.

(2) Production of Color Developer Sheet 20 g of β-phenoxyethyl-2,4-dihydroxybenzoate as an electron-accepting compound was dispersed in 200 g of a 5% aqueous solution of polyvinyl alcohol. In addition, 20 g of kaolin (Georgia kaolin) was added and well dispersed to prepare a coating solution. This coating solution was coated on paper and then dried to produce a developer sheet.

Upon application of stress or impulse on the color former sheet brought into contact with the developer sheet, a black image was formed instantaneously. This image was of high density and superior in light-resistance and heat-resistance.

EXAMPLE 2

5 g of 2-anilino-3-methyl-6-N-methyl-N-cyclohexylaminofluoran as an electron-donating colorless dye was placed in a ball mill along with 50 g of a 5% aqueous solution of polyvinyl alcohol (degree of saponification: 99%; degree of polymerization: 1,000) and dispersed therein over a 24 hour period. Similarly, 10 g of β-phenoxyethyl-4-hydroxybenzoate as an electron-accepting compound was placed in a ball mill along with 100 g of a 5% aqueous solution of polyvinyl alcohol and dispersed therein over a 24 hour period. The thus-prepared two dispersions were mixed, and then 20 g of kaolin (Georgia kaolin) was added and well dispersed therein. In addition, 5 g of a 50% paraffin wax emulsion dispersion (Cellosol #428, produced by Chukyo Yushi Co., Ltd.) was added to prepare a coating solution.

This coating solution was coated on paper (basis weight: 50 g/m$^2$) in an amount (as solids) of 6 g/m$^2$ and then dried at 60° C. for 1 minute to prepare a coated paper.

Upon heating the coated paper on a facsimile at a heating energy of 40 mJ/mm$^2$, a black image was formed. The color density was 0.93.

EXAMPLE 3

A coated paper was produced in the same manner as in Example 2, except that 5 g of 2-anilino-3-chloro-6-diethylaminofluoran was used as the electron-donating colorless dye and 10 g of β-phenoxyethyl-2,4-dihydroxybenzoate was used as the electron-accepting compound.

On heating the coated paper on a facsimile at a heating energy of 40 mJ/mm$^2$, a black image was formed. The color density was 1.07.

EXAMPLE 4

A coated paper was produced in the same manner as in Example 2, except that 5 g of 2-anilino-3-methyl-6-N-isoamyl-N-ethylaminofluoran was used as the electron-donating colorless dye and 10 g of β-o-chlorophenoxyethyl-2,4-dihydroxybenzoate was used as the electron-accepting compound.

On heating the coated paper on a facsimile at a heating energy of 40 mJ/mm$^2$, a black image was formed. The color density was 1.09.

COMPARATIVE EXAMPLE 1

A coated paper was produced in the same manner as in Example 3, except that 10 g of 2,2-bis(4-hydroxyphenyl)propane was used as the electron-accepting compound.

On heating the coated paper on a facsimile at a heating energy of 40 mJ/mm$^2$, a color image was formed. The color density was 0.58.

By comparison of Examples 2 and 3 with Comparative Example 1, it can be seen that the electron-accepting compounds of the present invention are much superior in color-forming properties.

EXAMPLE 5

20 g of 2-anilino-3-methyl-6-N-ethyl-N-isoamylaminofluoran was placed in a 300 ml ball mill along with 100 g of a 10% aqueous solution of polyvinyl alcohol (degree of saponification: 98%; degree of polymerization: 500) and dispersed therein over a 24 hour period to prepare a dispersion (A). Similarly, 10 g of β-phenoxyethyl-3,4-dihydroxybenzoate was placed in a 300 ml ball mill along with 100 g of a 10% aqueous solution of polyvinyl alcohol and dispersed therein over a 24 hour period to prepare a dispersion (B). Similarly, 20 g of bis[3,3-bis(4'-hydroxy-3'-tert-butylphenyl)-butanoic acid]glycol ester was placed in a 300 ml ball mill along with 100 g of a 10% aqueous solution of polyvinyl alcohol and dispersed therein over a 24 hour period to prepare a dispersion (C).

The dispersions (A), (B) and (C) were mixed at a weight ratio of 3/20/5, and 50 g of powdered calcium carbonate was added in an amount of 50 g per 200 g of the above mixture, and was thoroughly dispersed therein to prepare a coating solution.

This coating solution was coated on paper (basis weight: 50 g/m$^2$) in an amount (as solids) of 6 g/m$^2$ by the use of an air knife and then dried at 50° C. for 2 minutes to produce a heat-sensitive recording paper.

When the recording paper was heated on a facsimile at a heating energy of 40 mJ/mm$^2$, a black image was obtained. This image was very superior in storage stability.

EXAMPLE 6 TO 20

A mixture of 3 g of 2-anilino-3-methyl-6-N-methyl-N-cyclohexylaminofluoran and 2 g of 2-anilino-3-chloro-6-diethylaminofluoran as an electron-donating colorless dye was placed in a ball mill along with 50 g of a 5% aqueous solution of polyvinyl alcohol (degree of saponification: 99%; degree of polymerization: 1,000) and then dispersed therein over a 24 hour period. Similarly, 10 g of an electron-accepting compound as shown in Table 1 was dispersed in 100 g of a 5% aqueous solution of polyvinyl alcohol in a ball mill over a 24 hour period. In addition, 10 g of a heat-fusible material as shown in Table 1 was dispersed in 100 g of a 5% aqueous solution of polyvinyl alcohol in a ball mill over a 24 hour period.

The above-prepared three dispersions were mixed, and 20 g of kaolin was added and well dispersed therein. In addition, 5 g of a 50% paraffin wax emulsion dispersion (Cellosol #428 produced by Chukyo Yuski Co., Ltd.) was added to prepare a coating solution.

This coating solution was coated on a neutral paper (basis weight: 50 g/m$^2$) in an amount (as solids) of 6 g/m$^2$ and then dried at 60° C. for 1 minute to produce a coated paper.

Upon heating of the coated paper at a heating energy of 35 mJ/mm$^2$ on a facsimile, a black image was formed. The color density was determined by the use of a Macbeth Model RD-514 densitometer (produced by Macbeth Co., Ltd.). The results are shown in Table 1.

COMPARATIVE EXAMPLES 2 TO 6

The procedures of Exampls 6 to 16 were repeated, except that the heat-fusible materials were omitted. The results are also shown in Table 1.

TABLE 1

| Run No. | Electron-Accepting Compound | Heat-Fusible Material | Color Density |
|---|---|---|---|
| Example 6 | p-Methylbenzyl-2,4-dihydroxybenzoate | β-Phenethyloxy-p-biphenyl | A |
| Example 7 | p-Methylbenzyl-2,4-dihydroxybenzoate | 1-Octadecylurea | A |
| Example 8 | Butyl-2,4-dihydroxy-6-methylbenzoate | Benzyl p-benzyloxy benzoate | A |
| Example 9 | Butyl-2,4-dihydroxy-6-methylbenzoate | Phenylcarbamoyloxy-dodecane | A |
| Example 10 | Benzyl-2,4-dihydroxy-6-methylbenzoate | 2-Benzyloxy-naphthalene | A |
| Example 11 | Benzyl-2,4-dihydroxy-6-methylbenzoate | Phenyl 1-hydroxy-2-naphthoenate | A |
| Example 12 | Benzyl-2,4-dihydroxy-6-methylbenzoate | Stearyolanilide | B |
| Example 13 | β-Phenethyl-3,4-dihydroxybenzoate | 2-Benzyloxy-napthalene | A |
| Example 14 | β-Phenethyl-3,4-dihydroxybenzoate | p-Methoxycarbonyl-benzoic acid stearylamide | B |
| Example 15 | Benzyl-fluoro-glycinecarboxylate | 1-Benzyloxy-naphthalene | A |
| Example 16 | Benzyl-fluoro-glycinecarboxylate | Stearic acid amide | B |
| Example 17 | β-Phenoxyethyl-2,4-dihydroxybenzoate | 2-Benzyloxy-naphthalene | A |
| Example 18 | β-o-Chlorophenoxy-ethyl-2,4-dihydroxy-benzoate | 2-Benzyloxy-naphthalene | A |
| Example 19 | β-p-Methylphenoxy-ethyl-2,4-dihydroxy-benzoate | 2-Benzyloxy-naphthalene | A |
| Example 20 | β-(2-Methyl-6-chlorophenoxy)ethyl-2,4-dihydroxy-benzoate | 2-Benzyloxy-naphthalene | A |
| Comparative Example 2 | p-Methylbenzyl-2,4-dihydroxybenzoate | — | C |
| Comparative Example 3 | Butyl-2,4-dihydroxy-6-methylbenzoate | — | C |
| Comparative Example 4 | Benzyl-2,4-dihydroxy-6-methylbenzoate | — | x |
| Comparative Example 5 | β-Phenethyl-3,4-dihydroxybenzoate | — | x |
| Comparative Example 6 | Benzyl-fluoroglycine-carboxylate | — | x |

Note:
Color Density
A: More than 1.1
B: 1.0 to 1.1
C: 0.9 to 1.0
x: Less than 0.9

EXAMPLES 21 TO 26

5 g of 2-anilino-3-chloro-6-diethylaminofluoran as an electron-donating colorless dye was dispersed in 50 g of a 5% aqueous solution of polyvinyl alcohol (degree of saponification: 99%; degree of polymerization: 1,000) in a ball mill over a 24 hour period. Similarly, 10 g of benzyl 2,4-dihydroxy-6-methylbenzoate as an electron-accepting compound was dispersed in 100 g of a 5% aqueous solution of polyvinyl alcohol in a ball mill over a 24 hour period. Similarly, 5 g of a heat-fusible material as shown in Table 2 was dispersed in 100 g of a 5% aqueous solution of polyvinyl alcohol in a ball mill over a 24 hour period.

The above-prepared three dispersions were mixed, and then 20 g of kaolin (Georgia kaolin) was added and well dispersed. In addition, 5 g of a 50% paraffin wax emulsion (Cellosol #428 produced by Chukyo Yushi Co., Ltd.) was added to prepare a coating solution.

This coating solution was coated on a neutral paper (basis weight: 50 g/m$^2$) in an amount (as solids) of 6 g/m$^2$ and then dried at 50° C. for 2 minutes to produce a heat-sensitive recording paper.

Upon heating of the recording paper at a heating energy of 35 mJ/mm$^2$ by the use of a facsimile, a color image was formed. The color density was measured, and the results are shown in Table 2.

TABLE 2

| Run No. | Heat-Fusible Material | | Color Density |
|---|---|---|---|
| Example 21 | Benzyl-p-benzyloxy-benzoate | 1-Octadecylurea | A |
| Example 22 | p-β-Phenethyloxy-biphenyl | Stearoylanilide | A |
| Example 23 | 2-Benzyloxy-naphthalene | p-Methoxycarbonyl-benzoic acid stearyl amide | A |
| Example 24 | 2-Benzyloxy-naphthalene | 1-Octadecylurea | A |
| Example 25 | Phenyl-1-hydroxy-naphthoenate | Phenylcarbamoyloxy-dodecane | A |
| Example 26 | Phenyl-1-hydroxy-naphthoenate | Stearic acid amide | A |

Note:
Color Density
A: More than 1.1

It can be seen from Tables 1 and 2 that heat-sensitive recording materials of the present invention have high sensitivity.

EXAMPLE 27

20 g of 2-anilino-3-chloro-6-diethylaminofluoran was placed in a 300 ml ball mill along with 100 g of a 10% aqueous solution of polyvinyl alcohol (degree of saponification: 98%; degree of polymerization: 500), and dispersed therein over a 24 hour period to prepare a dispersion (A).

Similarly, 20 g of p-chlorobenzyl-2,4-dihydroxybenzoate was placed in a 300 ml ball mill along with 100 g of a 10% aqueous solution of polyvinyl alcohol and dispersed therein over a 24 hour period to prepare a dispersion (B).

Similarly, 20 g of 1,1,3-tris(2-methyl-4-hydroxy-5-tert-butylphenyl)butane was placed in a 300 ml ball mill along with 100 g of a 10% aqueous solution of polyvinyl alcohol and dispersed therein over a 24 hour period to prepare a dispersion (C).

The dispersions (A), (B) and (C) were mixed at a weight ratio of 3/10/5, and finely powedered calcium carbonate was added in an amount of 50 g per 200 g of the above mixture and thoroughly dispersed therein to prepare a coating solution.

This coating solution was coated on paper (basis weight: 50 g/m$^2$) in an amount (as solids) of 6 g/m$^2$ and then dried at 50° C. for 2 minutes to produce a heat-sensitive recording paper.

EXAMPLE 28

A heat-sensitive recording paper was produced in the same manner as in Example 27, except that 20 g of p-methylbenzyl-2,4-dihydroxybenzoate was used in place of 20 g of p-chlorobenzyl-2,4-dihydroxybenzoate to prepare the dispersion (B).

EXAMPLE 29

A heat-sensitive recording paper was produced in the same manner as in Example 27, except that 20 g of cyclohexyl-2,4-dihydroxybenzoate was used in place of 20 g of p-chlorobenzyl-2,4-dihydroxybenzoate to prepare the dispersion (B).

EXAMPLE 30

A heat-sensitive recording paper was produced in the same manner as in Example 27, except that 20 g of benzyl-3,4-dihydroxybenzoate was used in place of 20 g of p-chlorobenzyl-2,4-dihydroxybenzoate to prepare the dispersion (B).

EXAMPLE 31

A heat-sensitive recording paper was produced in the same manner as in Example 27, except that 20 g of 4,4'-thiobis(3-methyl-6-tert-butylphenol) was used in place of 20 g of 1,1,3-tris(2-methyl-4-hydroxy-5-tert-butylphenyl)butane to prepare the dispersion (C).

COMPARATIVE EXAMPLE 7

The dispersions (A) and (B) prepared in Example 27 were mixed at a weight ratio of 3/10, and 50 g of finely powdered calcium carbonate was added to 200 g of the above mixture and thoroughly dispersed therein to prepare a coating solution. Thereafter, in the same manner as in Example 27, the coating solution was coated to produce a heat-sensitive recording paper.

COMPARATIVE EXAMPLE 8

A mixture of 10 g of 2,2-bis(4-hydroxyphenyl)propane and 10 g of stearic acid amide was placed in a 300 ml ball mill along with 100 g of a 10% aqueous solution of polyvinyl alcohol and dispersed therein over a 24 hour period to prepare a dispersion (D).

The dispersion (A) prepared in Example 27 and the dispersion (D) prepared above were mixed at a weight ratio of 3/20. Thereafter, in the same manner as in Comparative Example 7, a heat-sensitive paper was produced.

The above-produced heat-sensitive recording papers were tested for fog, color-forming property, and moisture resistance.

(1) Fog and Color-Forming Property

Recording was conducted by applying an energy of 40 mJ/mm$^2$ on the recording paper by the use of a facsimile. Fog (the density of the ground prior to recording) and color density (initial density) after recording were measured by the use of a Macbeth Model D-514 reflective densitometer (using a visual filter).

(2) Moisture Resistance

The color image formed in the above test (1) was allowed to stand in an atmosphere of 40° C. and 90% RH and, thereafter, its density was measured. The residual ratio of the color was calculated by the following equation:

$$\frac{\text{Density after standing in humid condition}}{\text{Initial density}} \times 100\ (\%)$$

The results are shown in Table 3 below.

TABLE 3

| Heat-Sensitive Recording Paper | Fog and Color-Forming Properties | | Moisture Resistance Residual Ratio (%) |
|---|---|---|---|
| | Fog | Density | |
| Example 27 | 0.06 | 1.01 | 90 |
| Example 28 | 0.07 | 1.03 | 95 |
| Example 29 | 0.07 | 1.02 | 93 |
| Example 30 | 0.06 | 0.98 | 90 |
| Example 31 | 0.06 | 1.01 | 91 |
| Comparative Example 7 | 0.06 | 0.93 | 53 |
| Comparative Example 8 | 0.06 | 0.92 | 44 |

It can be seen from the results shown in Table 3 that the heat-sensitive recording papers of the present invention are higher in color density and more reduced in the disappearance of color than the comparative heat-sensitive recording papers.

While the invention has been described in detail and with reference to specific embodiments thereof, it will be apparent to one skilled in the art that various changes and modifications can be made therein without departing from the spirit and scope thereof.

What is claimed is:

1. A recording material containing (A) an electron-donating colorless dye and (B) an electron-accepting compound, wherein the electron-accepting compound is a compound represented by formula (IA) wherein said electron-accepting compound is represented by formula (IA):

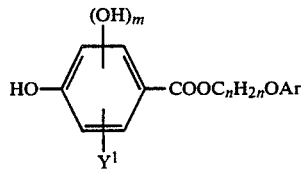

(IA)

wherein Ar represents an aryl group, $Y^1$ represents an alkyl group, an alkoxyl group, a halogen atom or a hydroatom atom, m is 0 or 1 and n is an integer of from 2 to 5.

2. A recording material as in claim 1, wherein the electron-accepting compound of formula (IA) is selected from the group consisting of compounds represented by formulae (IA-1), (IA-2), and (IA-3)

(IA-1)

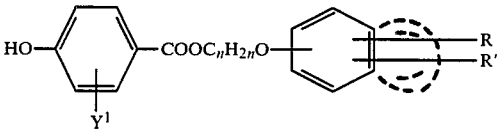

(IA-2)

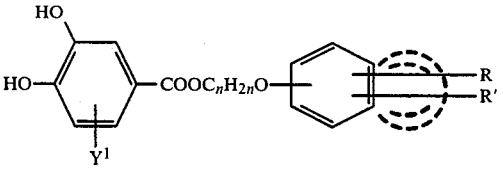

-continued (IA-3)

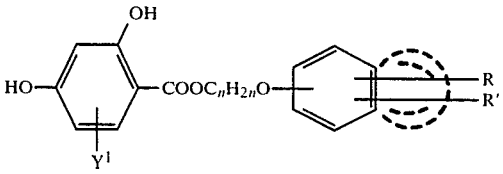

wherein R and R' each represent a lower alkyl group, a lower alkoxyl group, a halogen atom, or a hydrogen atom, $Y^1$ represents an alkyl group, an alkoxyl group, a halogen atom, or a hydrogen atom, and n is an integer of from 2 to 4.

3. A recording material as in claim 2, wherein R and R' each represents an alkyl group having from 1 to 4 carbon atoms, an alkoxyl group having from 1 to 3 carbon atoms, a chlorine atom, or a hydrogen atom, and n is 2 or 3.

4. A recording material as in claim 1, containing (A) an electron-donating colorless dye, (B) an electron-accepting compound of formula (IA), and (C) a heat-fusible material, wherein the electron-accepting compound (B) is a benzoic acid ester derivative having a hydroxyl group in the 4-position thereof and at least one aromatic hydroxyl group, and the heat-fusible material (C) is at least one of (1) a phenol derivative, (2) a naphthol derivative, and (3) a compound having an amido group in the molecule thereof, wherein compounds (1), (2) and (3) alone are substantially incapable of causing the electron-donating colorless dye to form a color.

5. A recording material as in claim 1, containing (A) an electron-donating colorless dye, (B) an electron-accepting compound of formula (IA), and (D) a hindered phenol compound.

* * * * *